US012808189B2

(12) United States Patent
Schlatter

(10) Patent No.: US 12,808,189 B2
(45) Date of Patent: Nov. 24, 2026

(54) STRUCTURAL BUILDING MATERIAL

(71) Applicant: Daniel Schlatter, Warsaw, IN (US)

(72) Inventor: Daniel Schlatter, Warsaw, IN (US)

( * ) Notice: Subject to any disclaimer, the term of this patent is extended or adjusted under 35 U.S.C. 154(b) by 190 days.

(21) Appl. No.: 18/780,734

(22) Filed: Jul. 23, 2024

(65) Prior Publication Data

US 2025/0034870 A1 Jan. 30, 2025

Related U.S. Application Data

(60) Provisional application No. 63/516,041, filed on Jul. 27, 2023.

(51) Int. Cl.

| | |
|---|---|
| ***E04B 2/00*** | (2006.01) |
| ***E04B 5/02*** | (2006.01) |
| ***E04C 2/04*** | (2006.01) |
| ***E04C 2/12*** | (2006.01) |
| *E04C 2/00* | (2006.01) |

(52) U.S. Cl.

CPC ..... *E04C 2/46* (2013.01); *E04C 2/044* (2013.01); *E04C 2/12* (2013.01); *E04C 2/50* (2013.01); *E04C 2002/004* (2013.01)

(58) Field of Classification Search

CPC ..... E04C 2/44; E04C 2/46; E04C 2/00; E04C 2/10; E04C 2/12; E04C 2/14; E04C 2002/004; E04B 1/02; E04B 2/46

See application file for complete search history.

(56) References Cited

U.S. PATENT DOCUMENTS

| | | | | |
|---|---|---|---|---|
| 3,630,813 | A | 12/1971 | Allen | |
| 4,503,115 | A | 3/1985 | Hemels et al. | |
| 6,964,809 | B2 | 11/2005 | Hojaji et al. | |
| 9,724,853 | B2 | 8/2017 | Zavala | |
| 10,113,305 | B2 | 10/2018 | Radford | |
| 2013/0305643 | A1* | 11/2013 | Singleton | E04C 2/284 |
| 2016/0311196 | A1* | 10/2016 | D'Ottaviano | B32B 5/18 |
| 2020/0181905 | A1* | 6/2020 | Jarck | E04C 2/10 |
| 2026/0009226 | A1* | 1/2026 | Zhou | E04C 2/28 |

FOREIGN PATENT DOCUMENTS

| | | | |
|---|---|---|---|
| CN | 2443837 | U | 6/2001 |
| CN | 105176130 | A | 12/2015 |
| EP | 2828101 | B1 | 9/2018 |
| JP | 2003009668 | A | 1/2003 |
| KR | 100799612 | B1 | 2/2008 |
| KR | 102197479 | B1 | 1/2019 |
| WO | 2008104772 | A1 | 9/2008 |

OTHER PUBLICATIONS

Characterization of Wood Fiber Insulation for the Development of Wood Fiber-Insulated Panels (WIPs) for Use in Building Envelope, 18 pages.

* cited by examiner

*Primary Examiner* — Joshua J Michener
*Assistant Examiner* — Henry Hooper Mudd
(74) *Attorney, Agent, or Firm* — Brian S. Bailey

(57) ABSTRACT

Load-bearing, insulative structural building panels are constructed from single, monolithically formed panels or bricks of material. The material may be made from cellulosic feedstock that can be sourced abundantly and inexpensively with minimal environmental impact. The resulting building panels may be used for walls, roofs or other panels in a finished building that can be constructed quickly and with less complexity as compared to traditional North American wall and roof assemblies.

3 Claims, 14 Drawing Sheets

STRUCTURAL BUILDING MATERIAL

CROSS REFERENCE TO RELATED APPLICATION

This application claims the benefit of U.S. Provisional Patent Application No. 63/516,041, filed Jul. 27, 2023 and entitled STRUCTURAL BUILDING MATERIAL, the entire disclosure of which is hereby incorporated herein by reference.

BACKGROUND

1. Technical Field

The present disclosure relates generally to building materials and, more specifically, to a load-bearing panel material for habitable structures.

2. Description of the Related Art

Residential construction is in high demand in many countries, but is getting more expensive. A typical budget for constructing a new house is out of reach for many aspiring homeowners, such as the roughly 28% of Americans who live alone or are otherwise on a single income.

A typical approach to building homes includes extensive use of standard lumber forms, such as lengths of 2×4 lumber arranged and joined to one another to construct site-built walls. Such walls might be laid out and joined, then sheathed and wrapped, before finishing. Typical lumber-constructed walls may be revisited by tradespeople 30-40 times in the process of building a home.

Modular homes and mobile homes are also an option. While modular subassemblies and trailerable complete homes can be effective at overcoming some of the barriers of cost and complexity in traditionally-built homes, modular and mobile homes are limited to certain size forms and can still carry a high cost.

What is needed is an improvement over the foregoing.

SUMMARY

The present invention provides a system and method for constructing load-bearing, insulative structural building panels from single, monolithically formed panels or bricks of material. The material may be made from cellulosic feedstock that can be sourced abundantly and inexpensively with minimal environmental impact. The resulting building panels may be used for walls, roofs or other panels in a finished building that can be constructed quickly and with less complexity as compared to traditional North American wall and roof assemblies.

In one form thereof, the present disclosure provides a structural building component including a single, monolithically formed panel of material. The material has a thickness between 2 inches and 10 inches, a density between 10 lbs/sq.ft. and 35 lbs/sq.ft., and an insulation R-value between 2/inch and 3/inch. The panel of material is suitable for use as a load-bearing component in a building assembly.

In another form thereof, the present disclosure provides a building including a foundation, a wall, and a roof. At least one of the wall and the roof comprises a structural building panel formed of a single, monolithically formed panel of material. The panel has a thickness between 2 inches and 10 inches, a density between 10 lbs/sq.ft. and 35 lbs/sq.ft., and an insulation R-value between 2/inch and 3/inch.

In yet another form thereof, the present disclosure provides a method of making a building, the method including assembling a plurality of monolithically formed panels of material to a building foundation in an upright orientation, such that each of the plurality of monolithically formed panels forms a respective section of a wall, each of the plurality of monolithically formed panels having a span of at least 6 feet, and assembling a roof to the plurality of monolithically formed panels such that the roof is structurally supported by the plurality of monolithically formed panels.

BRIEF DESCRIPTION OF THE DRAWINGS

The above mentioned and other features of this invention, and the manner of attaining them, will become more apparent and the invention itself will be better understood by reference to the following description of embodiments of the invention taken in conjunction with the accompanying drawings, where.

Corresponding reference characters indicate corresponding parts throughout the several views. All drawings are to scale except as otherwise noted herein (e.g., as a "schematic" view).

DETAILED DESCRIPTION

The embodiments disclosed below are not intended to be exhaustive or to limit the invention to the precise forms disclosed in the following detailed description. Rather, the embodiments are chosen and described so that others skilled in the art may utilize their teachings. While the present disclosure is primarily directed to a building material for, e.g., residential or commercial buildings, it will be appreciated that the present disclosure is also amenable to other industries and contexts.

The present disclosure provides a building material which provides structural support, a semi-finished appearance, and insulative properties using efficient, inexpensive materials and techniques. Traditional woodworking tools can be used to work with or modify the building material, such that it is suitable for site-built structures. The material can be produced in large quantities for low cost using wood fiber, other similar cellulosic materials, or foamed glass with a binder. These materials can also be produced with a minimal or neutral carbon footprint attributable to the finished building material product. For purposes of the following discussion, wood fibers will be discussed in connection with building assemblies 100, 200 and their constituent materials, it being understood that paper fibers or other cellulosic materials may also be substituted for some or all of the wood fibers in materials made in accordance with the present disclosure.

Figure 1:
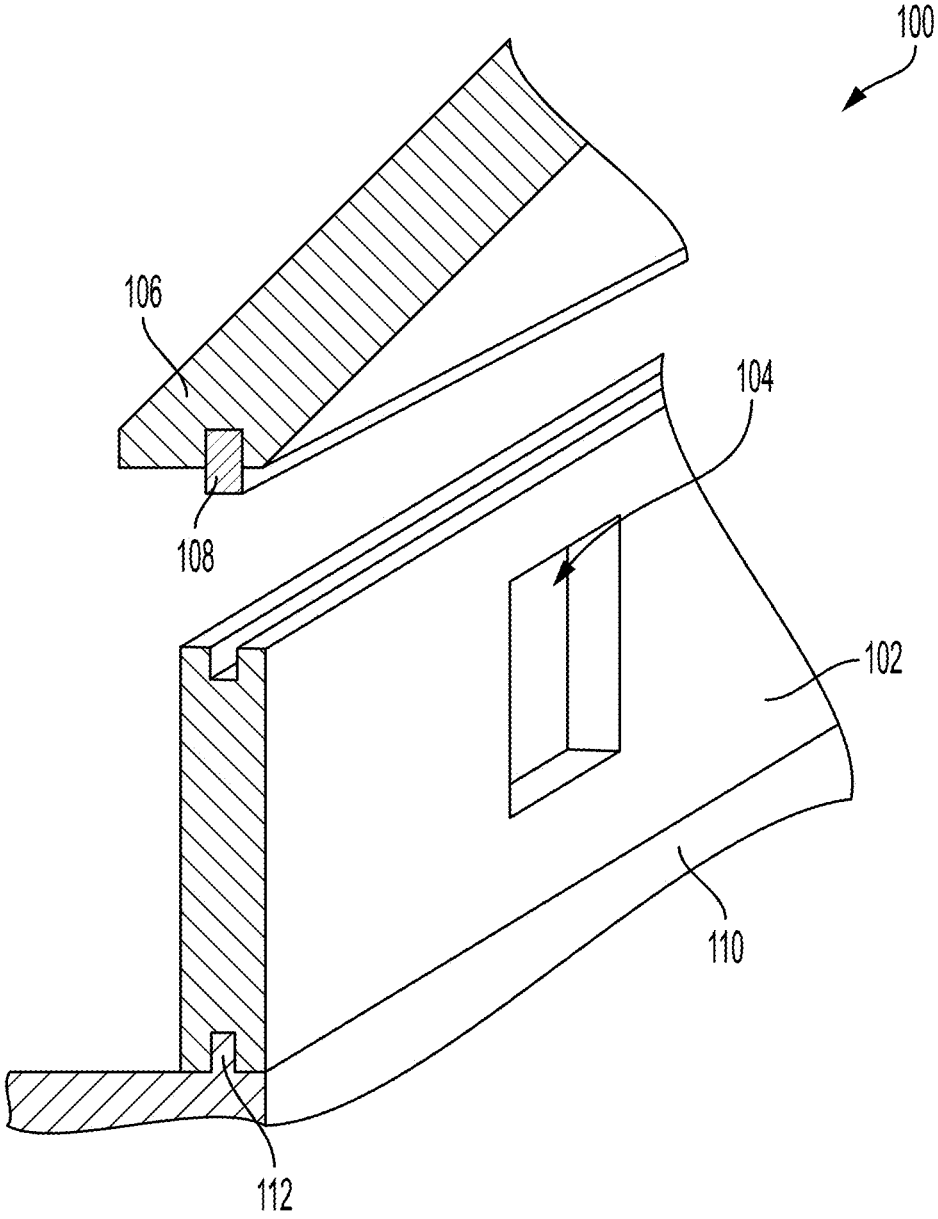
FIG. 1 is a perspective, exploded schematic view of a building using panels made in accordance with the present disclosure for a wall and roof.

Turning to FIG. 1, a building assembly 100 is shown which includes materials made in accordance with the present disclosure. In particular, building assembly 100 includes wall 102 and roof 106, which may each include or consist of a solid panel of the present building material, and a foundation 110 supporting the wall 102 and roof 106. For purposes of the present disclosure, wall 102 will be described in detail as being made from a panel of structural building material made in accordance with the present disclosure. However, it is contemplated that any building component, particularly structural building components, may be made from such material, including roof 106.

In the illustrated embodiment, wall 102 is connected to another structural building component, such as roof 106, by a key 108. Key 108 is embedded in a correspondingly sized groove at the top of wall 102 and at the bottom of roof 106. Similarly, a foundation 110, such as a concrete slab, may also connect to a bottom end of wall 102 via a key 112, which is fixed to foundation 110 (e.g., by embedded or cast-in fasteners, or the like). Keys 108 and 112 may provide for a consistent, durable and proper alignment between structural components, such as wall 102 and roof 106.

In order to fix such structural components to one another, nails or screws may be driven directly through the material of wall 102 and/or roof 106. The materials made in accordance with the present disclosure are capable of receiving and retaining such fasteners in a manner similar to solid softwoods, such as eastern pine, without any loss in structural load-bearing ability. Fasteners may be chosen with thread forms appropriate to the present material and, potentially, different from thread forms used for construction with eastern pine. Nails may also be used in some applications. Glue or other adhesives may be used to increase fastener holding strength, as required or desired for a particular application.

Wall 102 is made of a panel of the present building material without any underlying load-bearing substructure, such as a wood frame constructed of 2×4 or 2×6 lengths of lumber as used in conventional North American wall assemblies. Rather, wall 102 (or a section thereof) may be made entirely of a single, monolithic piece of the present material. This single, monolithically formed piece of material may also be a "sandwich" of multiple panels of the present material assembled as plies and fixed to one another, as further discussed below.

Wall 102 may include one or more fenestration openings. For example, FIG. 1 shows a rough opening 104 sized for a window, it being understood that similar rough openings may be made and sized for other fenestration applications, such as doors or any other fenestration openings as may be required or desired for a particular application. While wall 102 is illustrated with opening 104 in FIG. 1, it is contemplated that other building components, such as roof 106, may also include fenestration openings (e.g., for skylights, vents, chimneys, etc.).

Opening 104 may be a simple cutout in the material of wall 102, requiring no special assembly of components to form the rough opening 104 as would be created in conventional North American wall assemblies. That is, the rough opening 104 may be made solely by cutting a desired shape into the material of wall 102 using a cutting tool such as a saw. As a result of this cut, the opening 104 may extend across the thickness of wall 102 to expose an interior periphery of opening 104 that consists solely of exposed material in accordance with the present disclosure. In other words, the entire interior periphery of opening 104, across the entire thickness of wall 102, presents an exposed surface which consists entirely of material made in accordance with the present disclosure.

As noted above, wall 102 is made of a single, monolithically formed panel of material. This panel may be formed from a slurry and cured into pre-determined panel sizes, as described further below, and these pre-formed panels may then be used to easily and efficiently create wall 102. Wall 102 may have a thickness, defined as the shortest distance between its two major surfaces, of between 2 inches and 10 inches. Where the materials is used for roof 106, the thickness may be up to 20 inches. The density the R-value of the material may be substantially consistent throughout the entire volume of the wall 102, e.g., a measured density and R-value measured in any one area of the wall 102 may deviate by less than plus-or-minus 5% compared to all other comparable areas of the wall 102, it being understood that "comparable areas" are areas unaffected by any further treatments such as polymer infusions (as discussed herein). In nominal terms, the density of wall 102 may be between 10 lbs/sq.ft. and 35 lbs/sq.ft, such as between 18-21 lbs/sq.ft, and particularly about 20 lbs/sq.ft. The R-value of wall 102 may be between R2/inch and R3/inch, such as at least R2.6/inch for certain exemplary forms as described herein. This creates a wall material that is simultaneously load-bearing and insulative, as described herein, such that wall 102 is suitable for use as a load-bearing component in a building assembly but without the need for additional insulation to meet thermal performance benchmarks associated with habitable structures.

In one embodiment, an 8-inch panel used for a wall (e.g., wall 102 shown in FIG. 1) was made from 16 plies of ½" wood-fiber-based material bonded together as described herein. This wall exhibited an R-value of 23, equating to R2.8/inch. Additionally, the wall can be made from a single sheet of continuous material with no breaks along its lateral or vertical span, or the wall may be made from large (e.g., 4'×8') sheets with very few breaks along the span. This pairs the high R-value described above with a low air permeability for the overall wall assembly, resulting in superior thermal performance as compared to conventional wall assemblies.

Wall 102 may also include a semi-finished or finished exterior surface and a semi-finished or finished interior surface, which further facilitates the case of establishing a complete wall assembly using the present materials. For example, upon production of the solid panel of material used for wall 102, the broad surfaces which will form the interior and/or exterior surfaces of building 100 may be made with a planarity and smoothness comparable to commercial-grade drywall materials, such that wall 102 may be painted without further processing or preparation thereby eliminating the need for separate drywalling at the interior of building 100. In such cases, the interior surface of wall 102 may be considered a "semi-finished" surface ready for painting. In other cases, a user could decide to leave an interior surface of wall 102 in its original form, such that the surface of the original panel of material can be considered a "fully finished" surface.

The interior and/or exterior surfaces may also be water-resistant and impermeable to airflows, establishing an exterior water and air barrier that is comparable to commercial-grade house wrap materials, thereby eliminating the need for separate house wrapping at the exterior of building 100. Instead, fenestration openings such as window opening 102 may be made directly, and routing for siding installation may also be done without further preparation of wall 102. Additionally, siding may be installed directly to any part of wall 102 with nails or screws and retained with a strength and longevity comparable to typical 2×4 or 2×6 "stick-built" construction typical in North American wall assemblies.

The material from which wall 102 is made can be formed from different constituent materials in accordance with the present disclosure. In one embodiment, wood fiber material is combined with an evaporable liquid and a binder to form a slurry. This slurry is shaped into a single, monolithic pre-panel material having a size and shape commensurate with the desired form of the finished panel. This pre-panel is then cured into a single, monolithic panel of material, such as by application of heat and/or time for evaporation of the liquid, leaving the wood fibers directly affixed to one another by intertwining of wood fibers, and to a lesser extent, affixed to one another via the binder. For example, the wood fiber material may be mixed with hot water and/or steam into a slurry that is between about 98.5% and 99.5% water by weight. This slurry is mixed, freeing individual long wood fibers into mobility within the water-based slurry. A small amount of binder material, such as between about 0.5% and 12% by weight, may also be added to the slurry as discussed herein. As the water is subsequently drained and the slurry is pressed towards its final panel-shaped form, the mobile fibers naturally interleave and interlink with one another, creating a strong mechanical bond, as distinct from a chemical or binder-based, bond that would be more typical of a "papercrete" type product. For materials in accordance with the present disclosure, the small amount of binder used in the slurry enhances and protects this mechanical bond, rather than directly forming a bond between fibers.

As noted herein, the water used in the slurry is substantially all evaporated from the formed panel to create the finished material. Water content of a finished panel may be lower than, or commensurate with, other finished wood products, such as between 1-5% by weight.

The average length of the fibers in the wood fiber material may be modified according to the desired use or performance for the finished wall 102. Longer fibers enhance workability of the finished wall 102 by providing a smoother finish in cut or machined surfaces. Shorter fibers have more interlinked junctions per unit volume, creating higher strength in the finished wall 102. Fiber size (i.e., diameter) and length may be selected to balance strength and workability as required or desired for a particular application. For example, fiber sizes can vary in diameters within a range of about 25.0 to about 30.0 micrometers, and such fibers can have lengths within a range of about 827 to about 1,200 micrometers.

The resulting single, monolithic panel may then be used directly as a load-bearing structure, as described in detail herein with respect to wall 102. Alternatively, a "sandwich" of multiple panels of the present material may assembled as plies and fixed to one another, as noted above. For example, the plies of the sandwich may be permanently, uniformly bonded across their mating surfaces, such as by an adhesive material uniformly applied between the mating surfaces. For example, panels having a thickness between ¼-inch and 1 inch may be produced and bonded to one another in a multi-ply arrangement having a finished thickness between 4 inches and 10 inches or larger, such as up to 16 inches, 20 inches or 24 inches, or larger, as described above. In one particular embodiment, the thickness is between 7.5 and 8.5 inches, such as 8 inches as shown in FIGS. 2-10 described below. The thickness of a single ply may be as thin as ¼ inch and as thick as 8 inches, as required or desired for a particular application and depending on any applicable manufacturing constraints. A single ply may be used as the finished product for a wall or other panel as described below, but a multi-ply arrangement is still considered a "single, monolithically formed panel of material" in the context of the present disclosure, once the permanent bonding between the plies is completed.

In some embodiments, differing material properties may be chosen for the various plies of a multi-ply panel made in accordance with the present disclosure. For example, denser plies of material may be used as the outer plies of the overall sheet, providing for greater wear resistance, weather worthiness, or paint adhesion, for example. An outer layer of the panel can be densified by infusion of a polymer or other material, such as acrylic. The loose and open fiber of the present material is receptive to interdigitation of such a material at a depth up to about 1/16 inch on the broad surfaces, and deeper in the end grains. This creates a much harder outer surface than would otherwise be the case.

One exemplary adhesive material which may be used to bond plies to one another is protein lime adhesive. This is a non-cementatious adhesive material particularly well suited to the cellulosic materials used in the present panels, and which is suitable for use in the residential/commercial building and construction industry. Other non-cementatious adhesives may also be used in accordance with the present disclosure, such as polymer-based adhesives.

In some embodiments, a tension plane of material may be included between one or more of the plies in a multi-ply material. Such a tension plane may be a sheet of paper, for example, which is a very thin addition to the overall panel of material, but provides substantial tensile strength which may complement the inherent structural load-bearing qualities of the material of the panel itself. Alternatively, a polymer such as acrylic may be infused into the material of the panel, which densifies the material and makes is stronger in tension. In one embodiment, such infused polymers may be vacuum-drawn into the outer-edge area of the otherwise finished and cured panel, which prevents internal shear failures resulting from tension loads and thereby increases the overall tensile strength of the panel by preventing nucleation of tensile-driven material separation. Such infused polymers can also be used to provide water resistance, increased compressive strength and weight supporting capacity, and improved fastener holding capacity (i.e., higher pullout strength as noted herein).

In some embodiments, polymer saturation can be used at the outer surface of the panels used in an exterior position, such as wall 102. For example, one side of the panel may be saturated with polymer material, and this side may then be selected as the exterior-facing surface as wall 102 is constructed. Advantageously, this arrangement presents the polymer-infused side of the panel to the exterior elements, such as rain and high moisture, thereby protecting the underlying wood-fiber or other cellulosic substrate from damage due to moisture intrusion.

However, it is of course contemplated that the desired finished thickness may be formed in the panel itself, without a multi-ply arrangement. In some embodiments, the finished solid panels may take the form of bricks which are amenable to stacking against one another to build a masonry-type wall made of material in accordance with the present disclosure. In the case of a "panel" of material, the shortest length of a broad surface is at least 10 times the thickness of the material, while in a "brick" of material, the shortest length of a broad surface is no more than 3 times the thickness of the material.

In one embodiment, 4-foot by 8-foot panels are made having an 8-inch thickness made from 16 plies each having a ½" thickness and bonded to one another as described herein. The material for the panels may be produced on a continuous basis, i.e., a wide strip of material (e.g., having a width at least 4 feet, but potentially larger, such as 20 feet) may be continuously produced using raw inputs of wood fiber and adhesive. The production output may be expressed in feet of material per minute, e.g., 50 ft./min. This continuous output can then be rough-cut in motion with extra material at each side to account for inaccuracies or inconsistencies in the cut position or quality. The resulting rough-cut panels are rectified, meaning that each panel is trimmed at both sides and ends to made a perfect rectangular cuboid within acceptable tolerances. For example, a 4'×8' panel may be within 1 inch of its nominal height and width, and each corner may be within 0.1 degrees of perpendicular.

Rectified panels may then be edge glued to produce a larger finished panel, as may be required or desired for a particular application. get the same strength and have any size you want. (As big as you can move.) Advantageously, wood-fiber materials made in accordance with the present disclosure is highly fibrous at the glued edges, which allows a flowable adhesive to interdigitate deeply into fibers along the panel's edge. This interdigitation happens in each of the two panels abutting one another for the edge-gluing process, resulting in an exceptionally strong butt joint. For 8-inch thick, 16-ply panels as described herein, a 1600-pound load can be borne at the edge-glued joint and, where a large enough load is applied to break the panel, it can be observed that the fibers of each panel individually break indicating that the butt joint itself is not the main failure point. It has been observed that the original panel's break strength is reduced by less than 10%, a substantial improvement over conventional end-glued wood products. Moreover, because a butt joint can be used, material is saved compared to finger joints.

One class of materials useable to create panels in accordance with the present disclosure are cellulosic feedstocks, such as wood fibers as noted above. Other cellulosic materials suitable for use for panels include recycled cardboard and waste rice hulls. Advantageously, such materials are readily available in large quantities for a low cost. In one embodiment, finished panels made in accordance with the present disclosure have a very high cellulosic content, such as between 80% and 99%, or between 85% and 95% cellulose by weight. In one particular embodiment, cellulose content is about 95% by weight.

Another material useable to create panels in accordance with the present disclosure uses solid foam glass with a binder. Such materials are impervious to water and pests such as termites.

Materials made in accordance with the present disclosure, including wall 102 and roof 106 shown in FIG. 1, can be used for a fast and efficient building processes to create a finished building 100. For example, panels of a standard size and form, such sheets with standard measurements used in the building industry, can be prepared and pre-finished in a factory setting. Such sheets may be 4×8 feet, for example, but may also be larger, with heights of 8 feet, 9 feet, or greater, and lengths of 6 feet, 8 feet, 10 feet, 12 feet or longer. Sheet heights may be formulated to match the full wall height of a building, such as wall 102, such that a single sheet can be used to construct a full-height section of wall 102. These pre-finished sheets can then be stood upright and fastened together, such as by standard fasteners as noted above to form wall panels 102. Fenestration openings, such as window opening 104, may be made in the factory or on-site, as required or desired for a particular application. For a typical building 100, a plurality of these pre-finished panels may be assembled to foundation 110, and to one another, to form a section of a wall. In some cases, smaller panels may be used, but a panel having a span (i.e., a length) of at least 6 feet will be used to ensure efficient assembly.

Roof 106, which may also be made of material panels made in accordance with the present disclosure, can then be assembled to the plurality of wall panels 102. The load-bearing portion of wall assembly may be made entirely of wall panels 102, such that roof 106 is structurally supported by the plurality of monolithically formed panels. Moreover, building 100 may exclude any underlying or other load-bearing substructure, such that roof 106 is structurally supported solely by wall panels 102.

Where panels are joined to another to create a larger structure such as building 100, joinery may be adjusted to account for the relatively low flexibility and high strength of the panels as described above. For example, joint surfaces on each of two mating panels may be machined to provide high-tolerance joinery.

Turning now to FIGS. 2-10, a building assembly 200 is shown utilizing wall panels made in accordance with the present disclosure. FIGS. 2-10 are drawn to scale as noted herein. Except as otherwise described below, building assembly 200 is similar in structure and function to building 100, and reference numerals of building assembly 200 are analogous to the reference numerals used in building 100, except with 100 added thereto. Elements of building assembly 200 correspond to similar elements denoted by corresponding reference numerals of building 100, except as otherwise described herein. Moreover, descriptions herein pertaining to building 100 also pertain to building assembly 200, and vice versa, except as otherwise explicitly stated herein.

Figure 2:
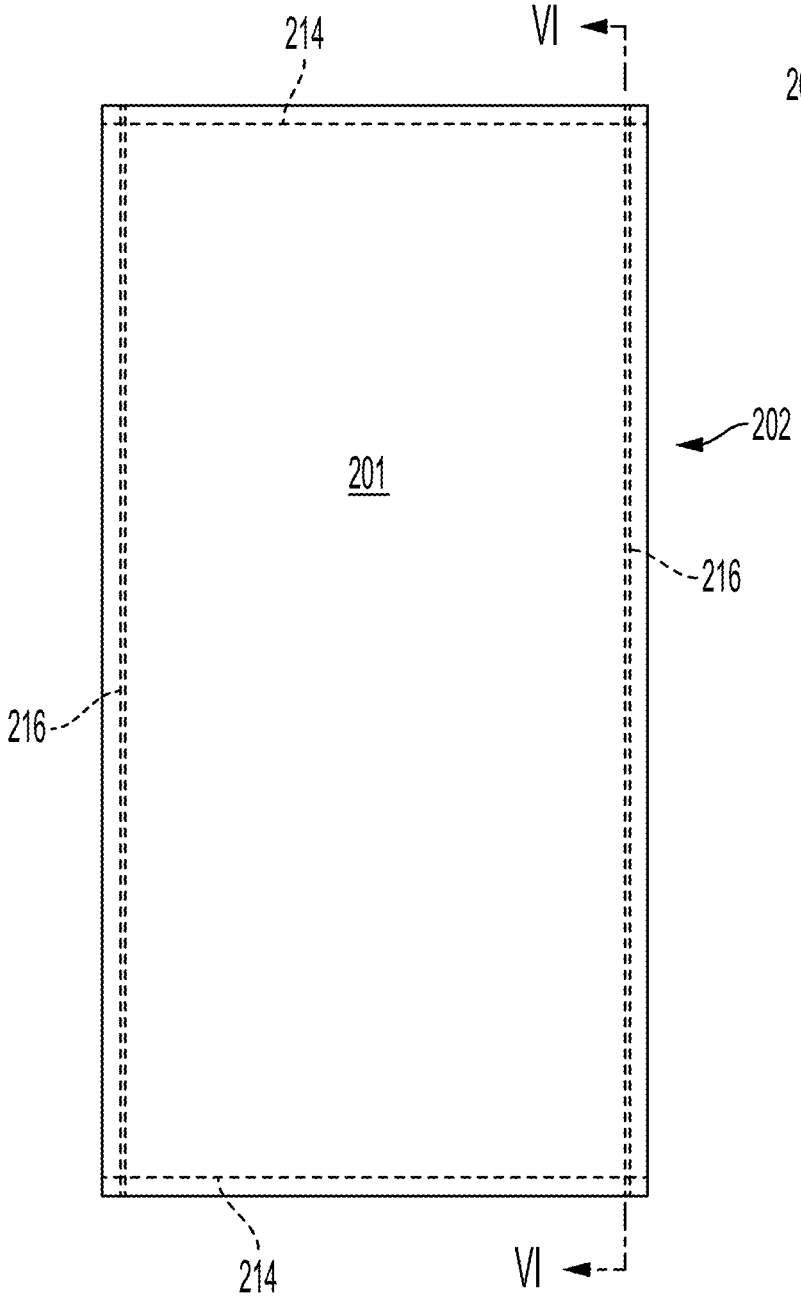
FIG. 2 is a front elevation view of a wall panel made in accordance with the present disclosure.

FIG. 2 illustrates a wall panel 202 which can be used for building assembly 200. Wall panel 202 includes a substrate which is made of materials described above with respect to wall 102. In the illustrated embodiment, wall panel 202 has an 8-inch thickness (FIG. 3), though other thickness are of course envisioned as described in detail above.

Figure 3:
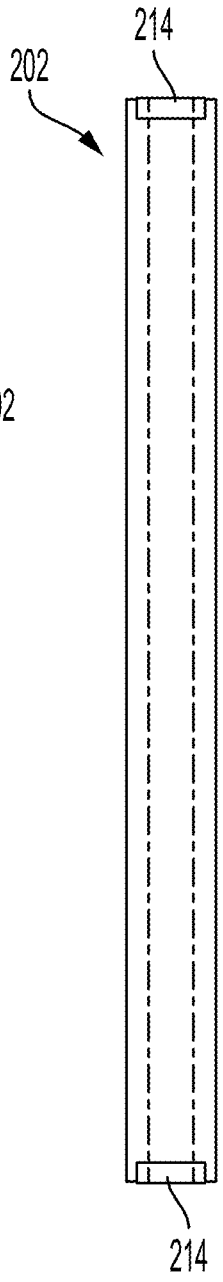
FIG. 3 is a side elevation view of the wall panel shown in FIG. 3.

Wall panel 202 includes a set of lateral grooves and upright grooves which, taken together, create a circumferential groove around the entire circumference of the wall panel 202. This groove may occupy at least half, and in some cases up to 80%, of the thickness of panel 202. In the illustrated embodiment, the groove has a 6-inch width, i.e., 75% of the overall thickness. As shown in FIG. 3, this circumferential groove may receive a plurality of perimeter beams or boards, i.e., lateral perimeter boards 214 (also shown in FIG. 3) and upright perimeter boards 216. For purposes of the present discussion, "boards" will be referenced in connection with the perimeter strengthening beams shown and described herein, it being understood that a "board" can be any elongate structure made of any suitable material in accordance with the present disclosure.

In one embodiment, boards 214, 216 may be formed from a strong, dimensionally stable lumber product such as laminated veneer lumber (LVL), which is a dense and impact-resistant engineered wood product that uses multiple layers of thin wood assembled with adhesives. Other products are also contemplated for use in connection with boards 214, 216, such as solid lumber or composites. In the case of LVL, boards 214, 216 provide exceptional strength and fastener holding ability which facilitates joining of wall panels 202 to one another and to other building structures, as described further herein. Boards 214, 216 may be fixed within their respective grooves by spray adhesive or similar adhesive materials, as well as mechanically retained by a press-fit.

Figure 6:
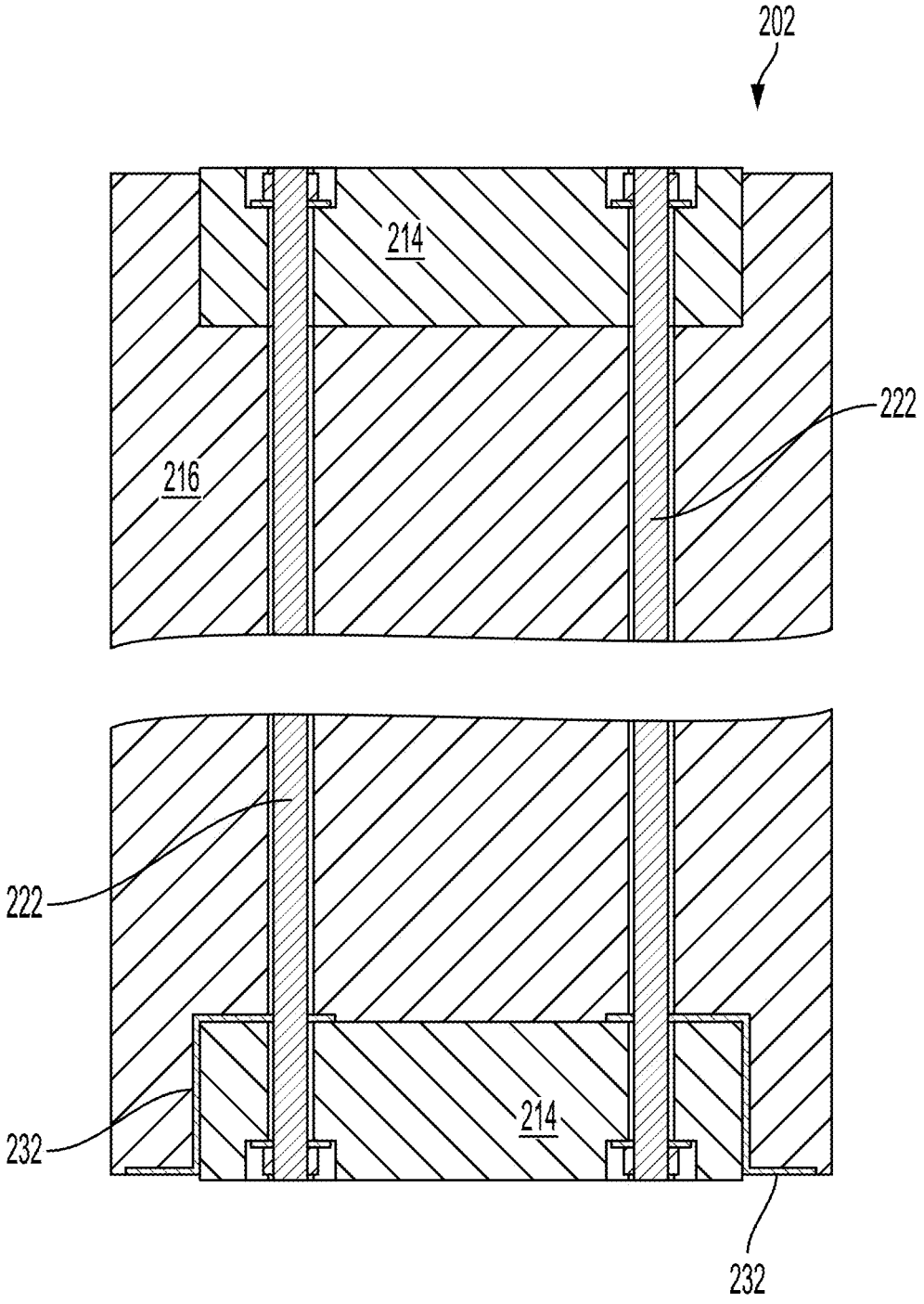
FIG. 6 is a side elevation, cross-section and broken view of the wall panel shown in FIG. 2, taken along the line VI-VI of FIG. 2, illustrating end details.

As shown in FIG. 6, boards 214 may sit slightly proud of the surrounding substrate 201. This protects the edges of the substrate 201 from impact or other damage during handling and construction of building assembly 200. Moreover, boards 214 also ensure that mechanical loads placed on the wall panel 202 will be even distributed across the substrate 201, avoiding not just impact damage but any concentrated loading of substrate 201 during its service as a part of building assembly 200. Additionally, boards 214 may be more resistant to moisture uptake as compared to substrate 201. If wall panel 202 is rested on edge at a wet location (as may be typical in staging a construction site, for example), boards 214 sitting proud of substrate 201 will also maintain a gap between the substrate and the adjacent wet surface, further protecting substrate from any moisture uptake.

Figure 4:
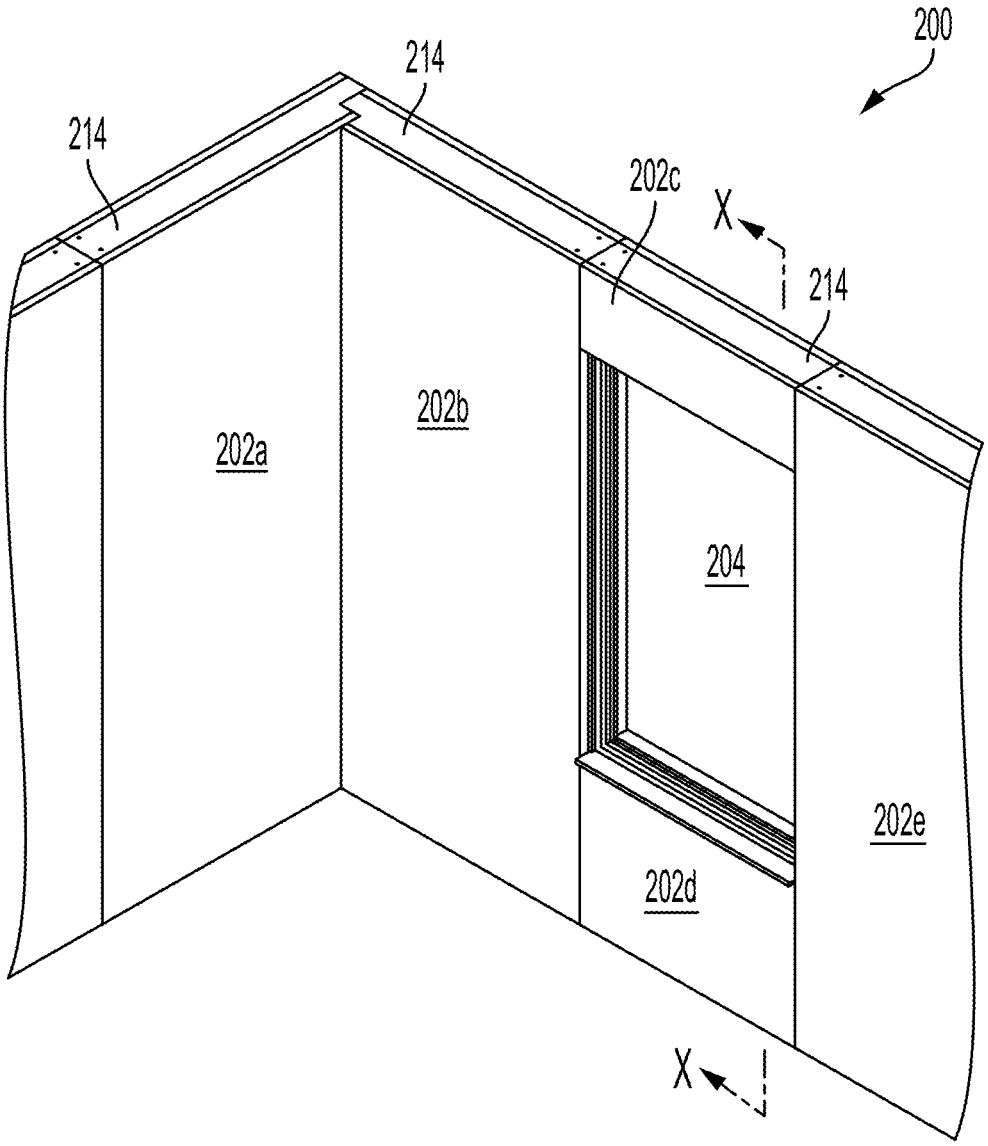
FIG. 4 is a perspective view of multiple ones of the wall panel shown in FIG. 2, assembled into a building assembly made in accordance with the present disclosure.
Figure 5:
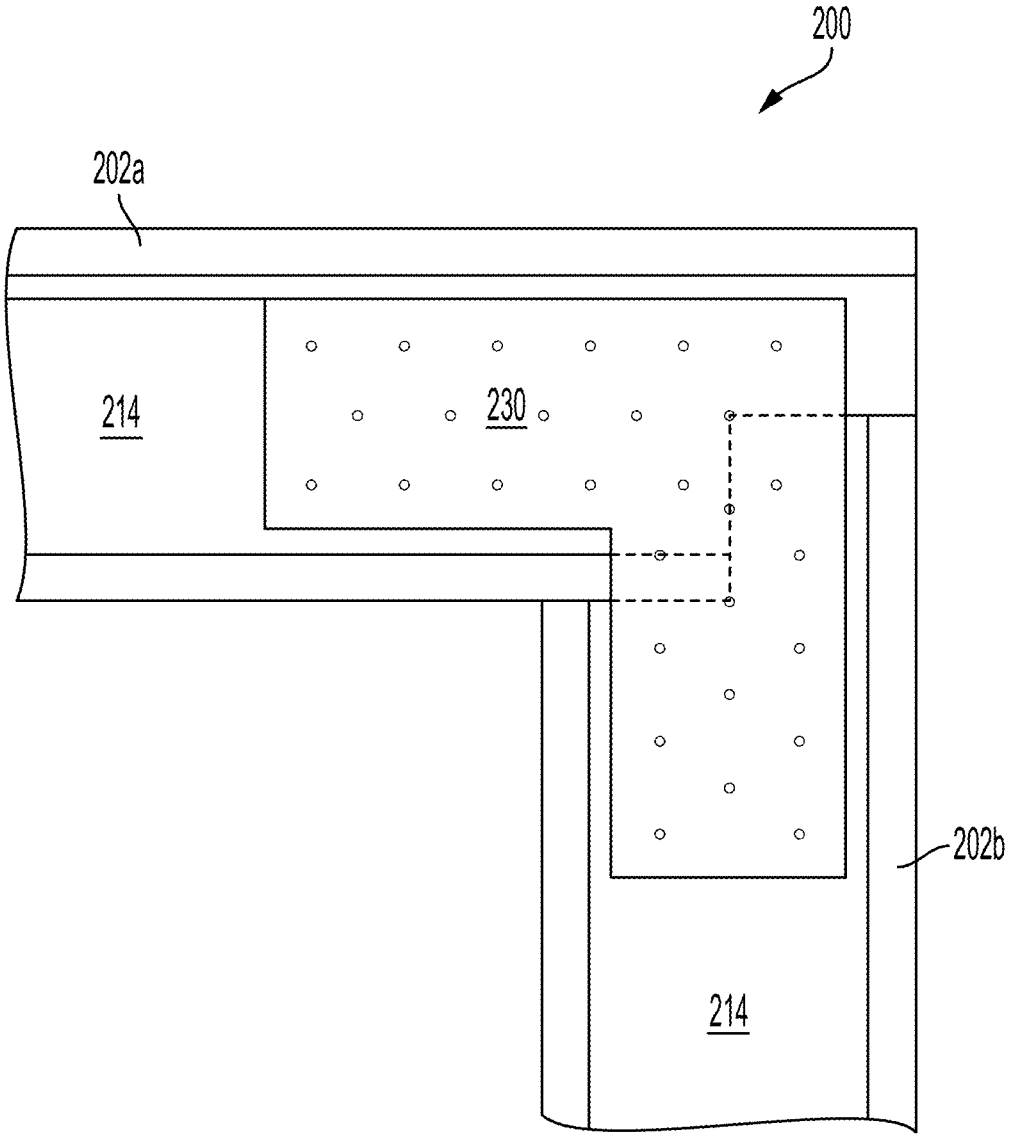
FIG. 5 is a top plan view of a corner of the building assembly shown in FIG. 4.

One application of multiple panels 202 joined to one another is shown in FIG. 4, which illustrates a corner between two wall assemblies for building assembly 200, with a fenestration opening 204 formed in one of the walls. At the corner, a first panel 202*a* meets a second panel 202*b*, forming an angle (e.g., a 90-degree or generally perpendicular angle) therebetween. In one embodiment, each panel 202*a*, 202*b* has a vertically-extending groove machined therein which configured to mate with the other groove in the manner of a lap joint to form the corner junction, as shown in FIGS. 4 and 5. Each such vertical groove may be coated with adhesive to bind the mating surfaces to one another. Advantageously, such adhesive also interdigitates with the material of substrate 201 in each of the wall panels 202, creating an exceptionally strong bond at the mating surfaces. In one embodiment, the grooves may have a width and depth equal to half of the thickness of the respective panels 202*a*, 202*b*. For example, for an 8-inch thick wall as illustrated, the width and depth of each groove may be 4 inches (i.e., the cross-section of the groove is a 4-inch square).

Additionally, a joining plate 230 may be used to further solidify and strengthen the joint as shown in FIG. 5. Plate 230 may be a steel plate with a series or array of holes positioned to correspond with the location of boards 214, such that fasteners may be run through each of the holes and into the boards 214 to firmly fix plate 230 to the respective wall panels 202*a*, 202*b*.

To form fenestration opening 204, a header wall panel 202*c* may be mated to panel 202*b* at an upper end thereof, and a sill wall panel 202*d* may similarly be mated to panel 202*b* at a lower end thereof. Fenestration opening 204 may also include a number of additional features to facilitate the installation of a window (or a door), as described below with regard to FIGS. 9 and 10.

Turning to FIG. 6, a cross-section and broken view of wall panel 202 and upright boards 216 illustrates cross members 222 passing through the height of substrate 201 and boards 216 along an upright direction. In one embodiment, cross members 222 are metal rods that are partially or entirely threaded to accept threaded fasteners for fixation to a foundation or a roof, as described further below. Other structures capable of bearing tensile loads, such as straps, rebar or dowel rods, could also be used in accordance with the present disclosure.

Cross members 222 are seated within respective grooves formed in the inwardly-facing surface of boards 216, and as such, are also positioned sufficiently inwardly of the outer surfaces of substrate 201 to pass through boards 214 with a margin around each cross member 222. When boards 216 are seated within their respective grooves formed in substrate 201, cross members 222 may be seated therein. Boards 214 may then be seated over the ends of the cross members 222, as shown in FIG. 6, such that cross members 222 are flush with or slightly recesses below the outer surfaces of the upper and lower boards 214. Boards 214 may have a counterbore sized to receive a nut, with one nut is threaded to each end of the cross members 222 as shown. In this way, cross members 222 embed a tensile strength element into wall panel 202. Any tensile load placed on wall panel 202 can be carried at least partially by cross members 222.

Figure 7:
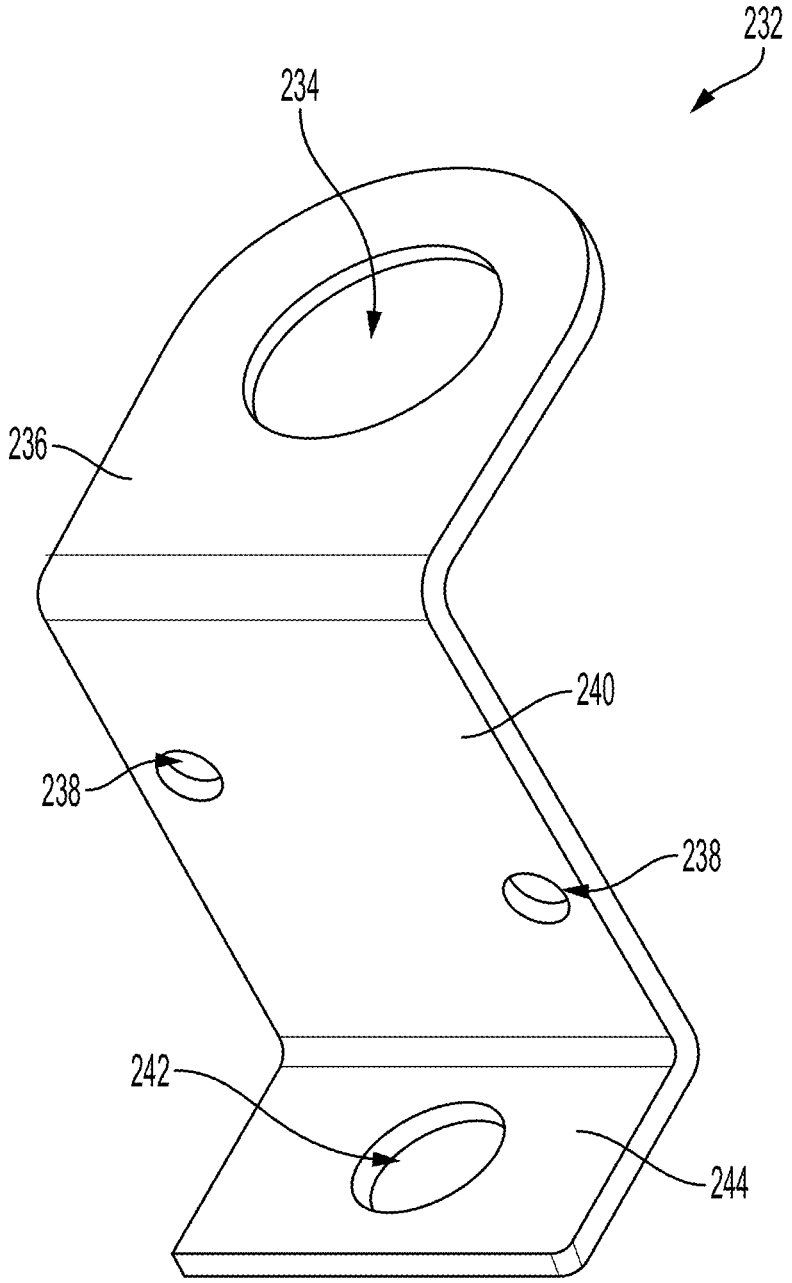
FIG. 7 is a perspective view of a tie strap used with the wall panel shown in FIG. 6.

Additionally, wall panel 202 may include straps or ties 232 each formed as a Z-shaped rigid (e.g., metal) plate which is fixed to substrate 201, as shown in FIG. 6. FIG. 7 shows a detailed view of the 232, including a cross member aperture 234 in a first or upper flange 236, screw holes 238 in a central portion 240, and an anchor aperture 242 in a second or lower flange 244 opposite the upper flange 236. A the 232 is installed within the groove housing the lower board 214 at each of the four lower corners of wall panel 202 (two of these corners being shown in FIG. 6, it being understood that the opposite two corners are arranged the same). The board 214 is then installed over the seated ties 232, and screws (not shown) may be driven through the screw holes 238. In one embodiment, the material of substrate 201 may be removed to allow passage of each screw and a plug may be installed over the installed screw head. Alternatively, ties 232 can be fixed to board 214 (e.g., by screws or nails) and the resulting assembly can be installed within the groove of substrate 201. Once ties 232 and the lower cross member 214 are seated and connected to substrate 201, cross members 222 may then be passed through each respective aperture 234 of the four installed ties 232 during installation of upright boards 216 (as described above).

Figure 8A:
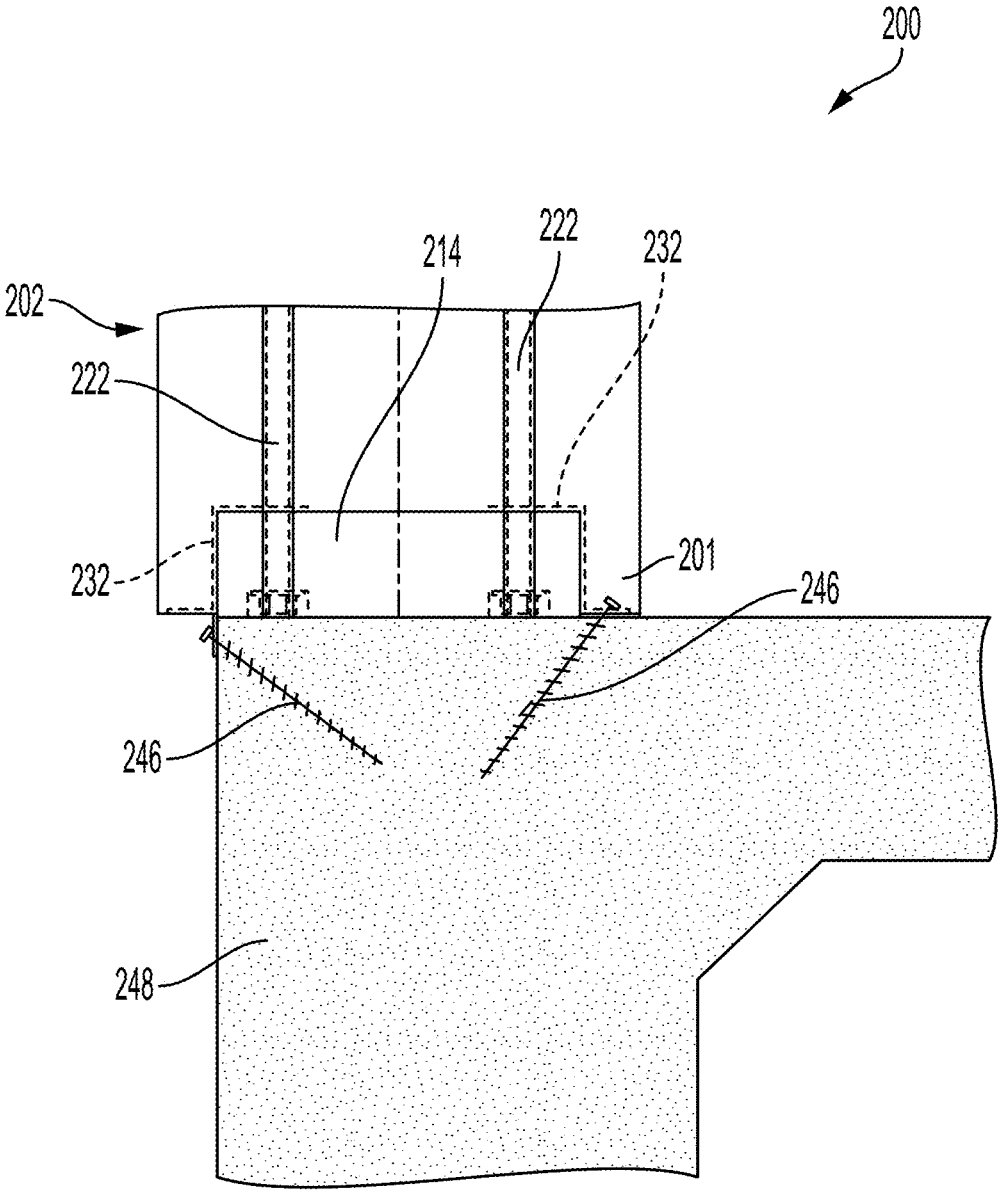
FIG. 8A is a side elevation, cross-section view of a joint between the wall panel of FIG. 2 and a concrete foundation.

Upon installation of ties 232, lower flange 244 is left exposed along the lower surface of wall panel 202. Turning to FIG. 8A, flanges 244 located along an interior surface of panel 202 may be accessed by fasteners drilled through a portion of substrate 201, then through anchor aperture 242, and finally into a concrete foundation 248. Alternatively, selected portions of substrate 201 may be cut away to expose anchor aperture 242, either before or after installation of ties 232, thereby allowing anchors 246 to be passed directly through anchor apertures 242 and into foundation 248. In this way, anchors 248 fix wall panel 202 to a lower support surface, such as a concrete foundation 248 shown in FIG. 8A, via ties 232.

Flanges 244 located along an exterior surface of panel 202 may be bent down to rest flush against an abutting vertical surface of the concrete foundation 248, as shown in FIG. 8A. In this case, anchors 246 can be passed directly through the anchor aperture 242 and into the foundation 248, as shown.

Figure 8B:
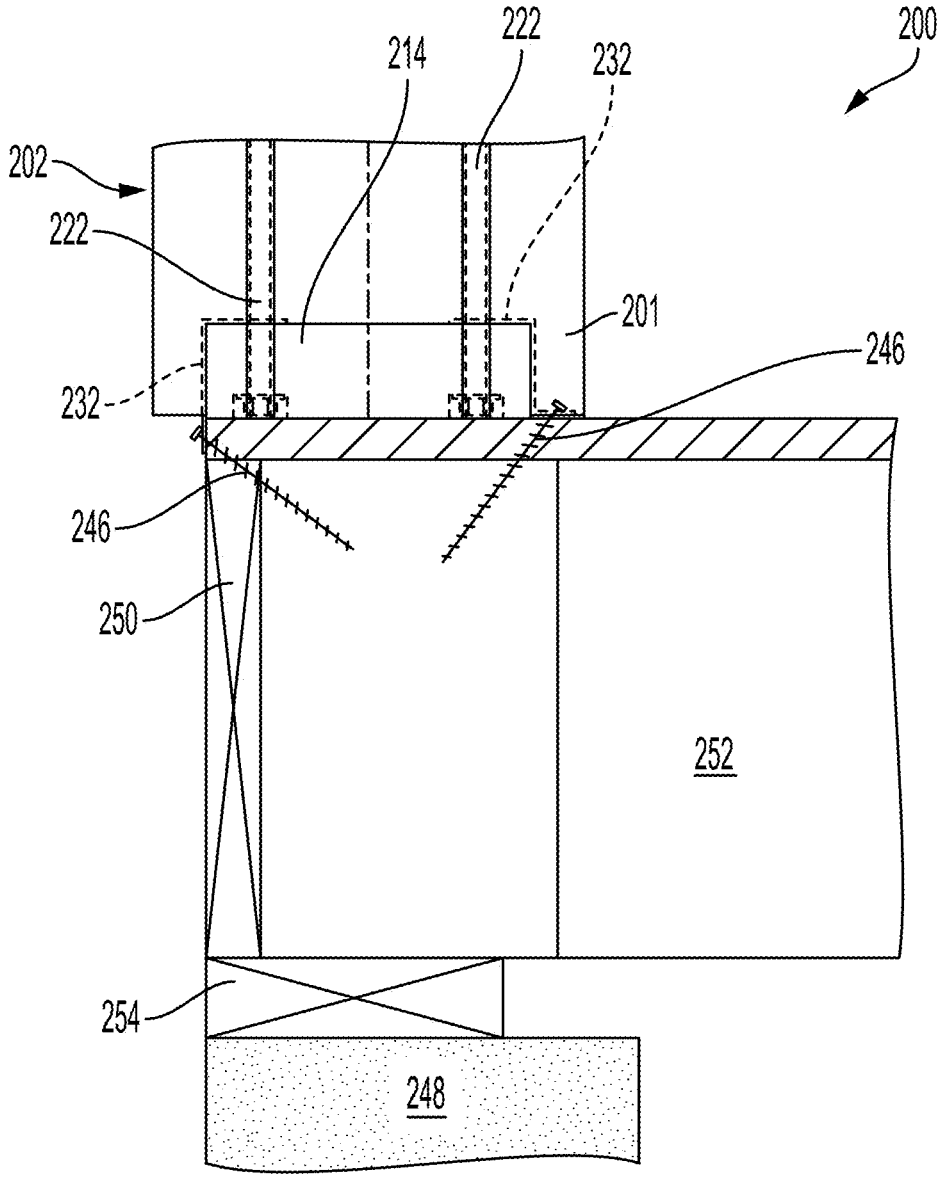
FIG. 8B is a side elevation, cross-section view of a joint between the wall panel of FIG. 2 and a floor assembly.
Figure 8C:
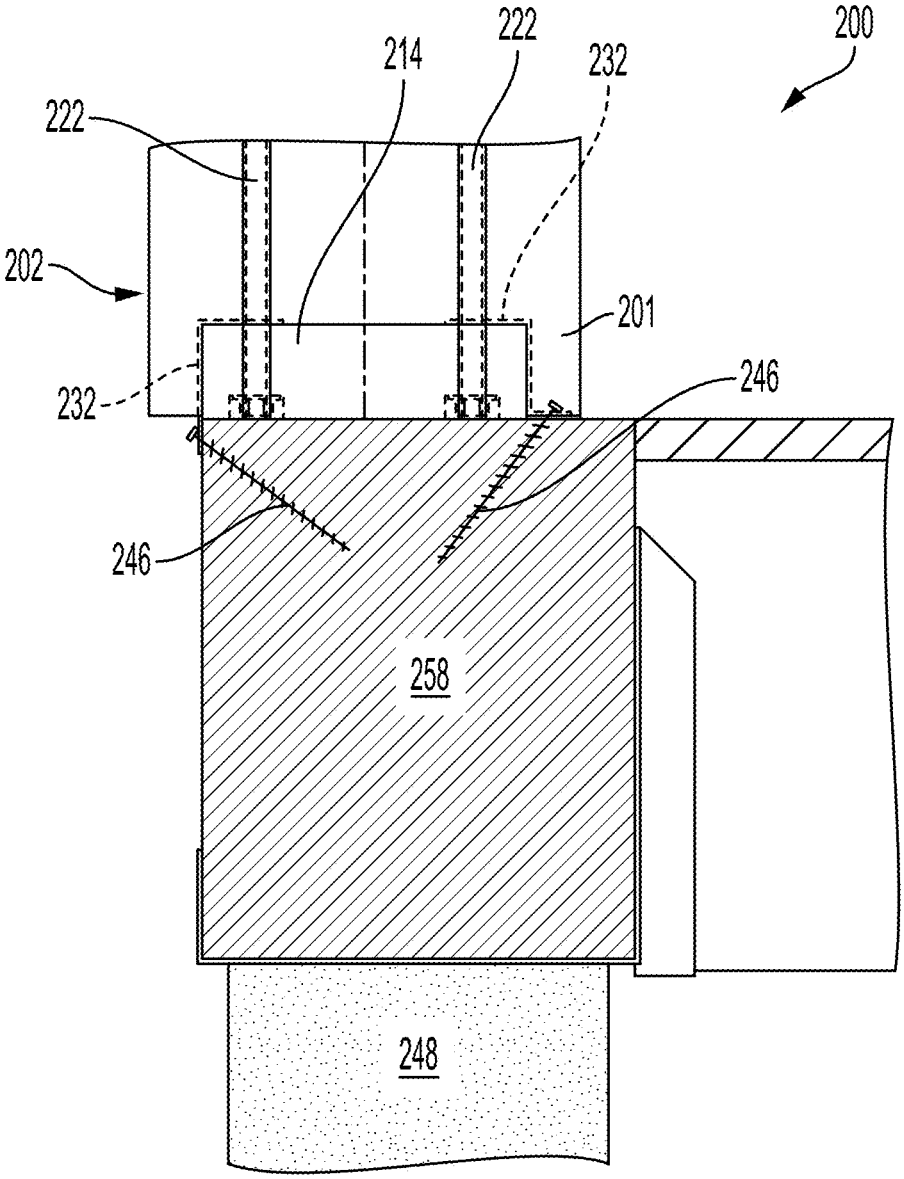
FIG. 8C is a side elevation, cross-section view of a joint between the wall panel of FIG. 2 and another floor assembly.

Wall panel 202 having ties 232 can also be mounted to any other type of foundation or support surface, as shown in FIGS. 8B and 8C. In FIG. 8B, fasteners 246 are shown fixed to a rim joist 250 and/or floor joists 252 and/or blocking 254 installed between floor joists 252, as shown. In this case, the foundation 248 is a pier or other concrete structure supporting the floor assembly via a mud sill 256. In FIG. 8C, fasteners 246 are fixed directly to a perimeter beam 258 as shown, which in turn is supported by foundation 248.

Figure 9A:
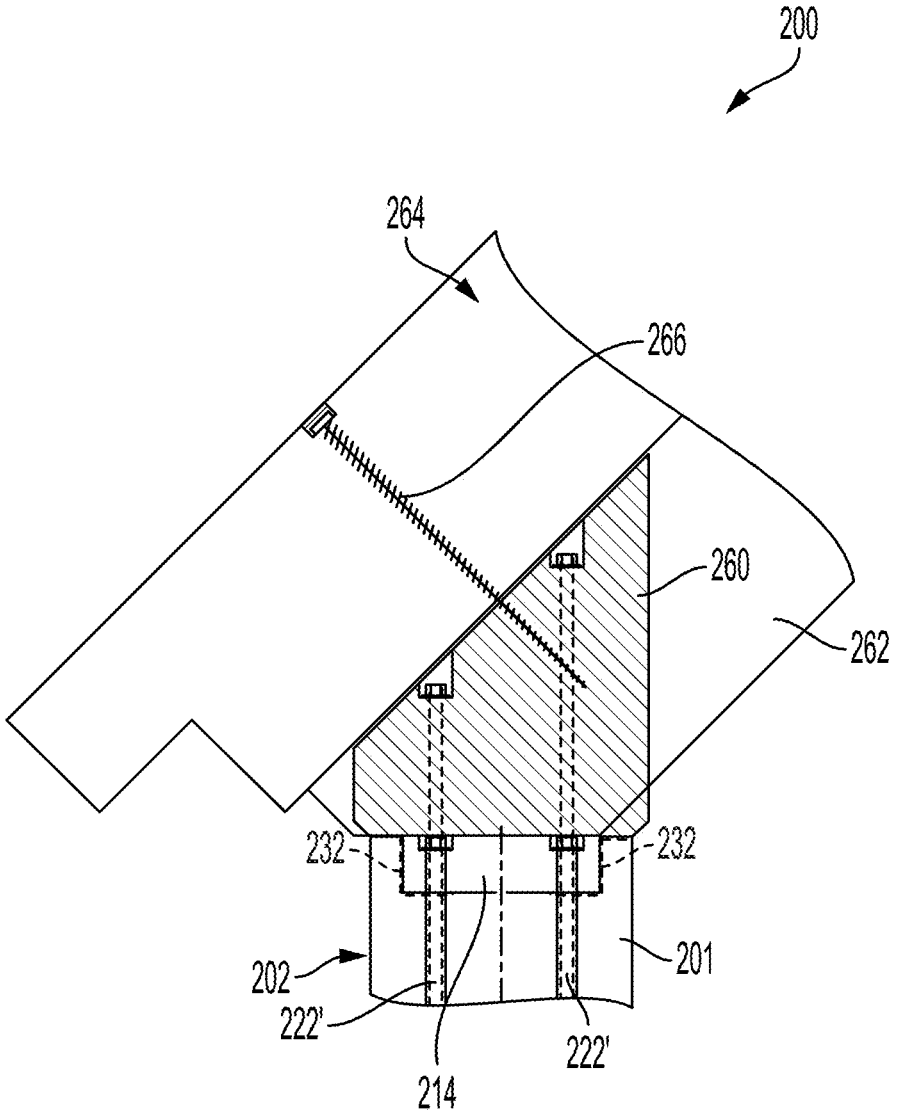
FIG. 9A is a side elevation, cross-section view of a joint between the wall panel of FIG. 2 and a pitched roof assembly.

Turning now to FIG. 9A, wall panel 202 is also configured for firm fixation to a roof assembly, such as pitched roof 264 as shown. A block 260, made of wood or other suitable material, may be fixed to the top of wall panel 202 via cross members 222', which may be made longer as compared to cross members 222 to pass through block 260 as shown, but may otherwise be identical to cross members 222 as described herein. Block 260 may, in some embodiments, be placed between adjacent pairs of roof rafters 262, with several blocks 260 arrayed across the lateral roof span. Roof assembly 264 may then be fixed to each block 260 using long fasteners 266. The exposed heads of fasteners 266 may be sealed with sealant and/or plugs to prevent water intrusion. In the illustrated embodiment, roof assembly 264 may be made from a panel made in accordance with the present disclosure, such as panel 202, with appropriate modifications for the roof application. Roof assembly 264 is shown schematically, it being understood that any combination of features described herein may be applied to the roof 264, as required or desired for a particular application.

Figure 9B:
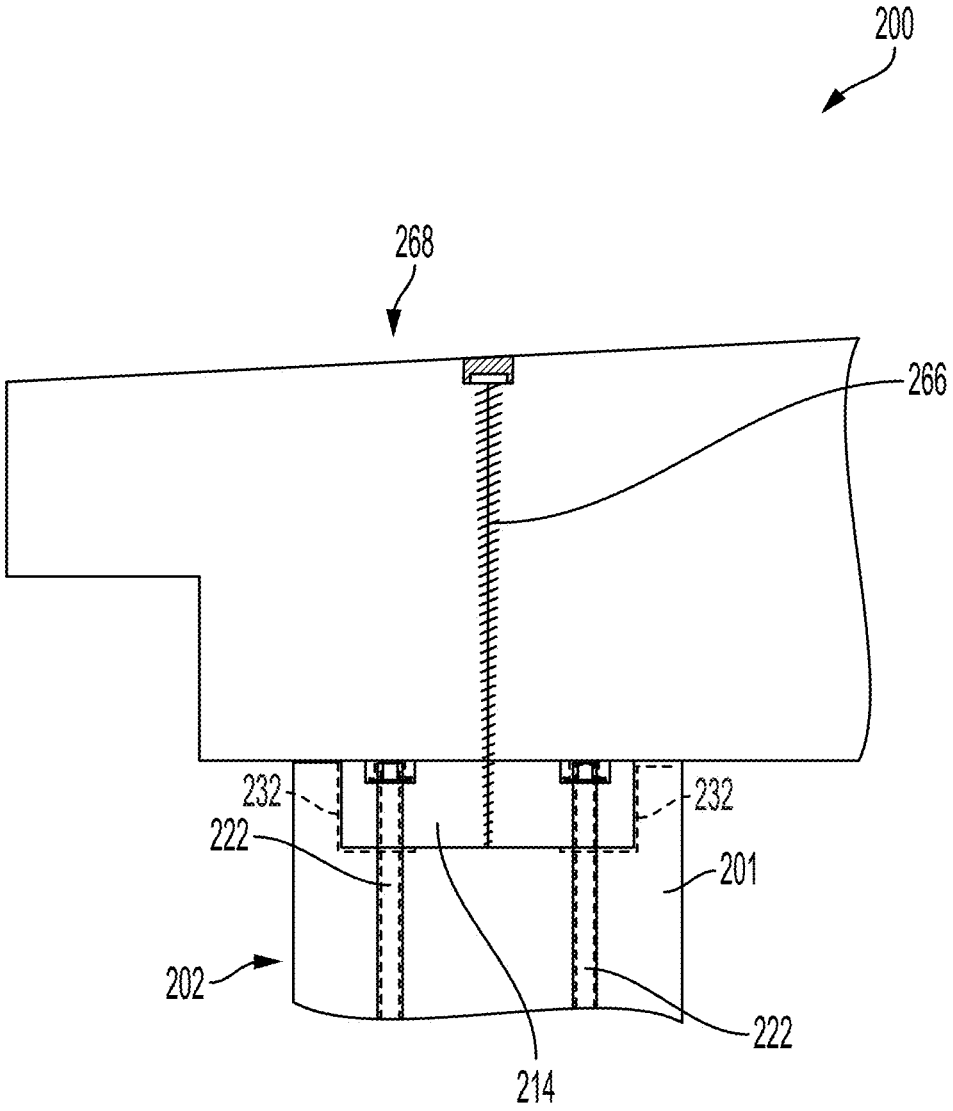
FIG. 9B is a side elevation, cross-section view of a joint between the wall panel of FIG. 2 and a flat roof assembly.

FIG. 9B shows another application in which wall panel 202 mated to roof assembly 268 to create a building assembly 200 is a "flat-roof" type design having a roof pitch that is angled only slightly with respect to horizontal (e.g., between 1 and 10 degrees). In this application, block 260 may be excluded with the underside/inside surface of roof assembly 266 mounted directly to the top of wall panel 202 via fasteners 266. In this case, fasteners 266 engage directly with board 214, as shown, after passing through the roof assembly 266. Roof assembly 266 may include a substrate (e.g., substrate 201) that is designed with a tapering cross-sectional profile, as shown, to create the low pitch needed for the flat-roof type design. To accomplish this low pitch, the substrate may be machined or milled from a uniformly thick cross-section to the tapered cross-section shown, or may be specially formed with a native taper.

Figure 9C:
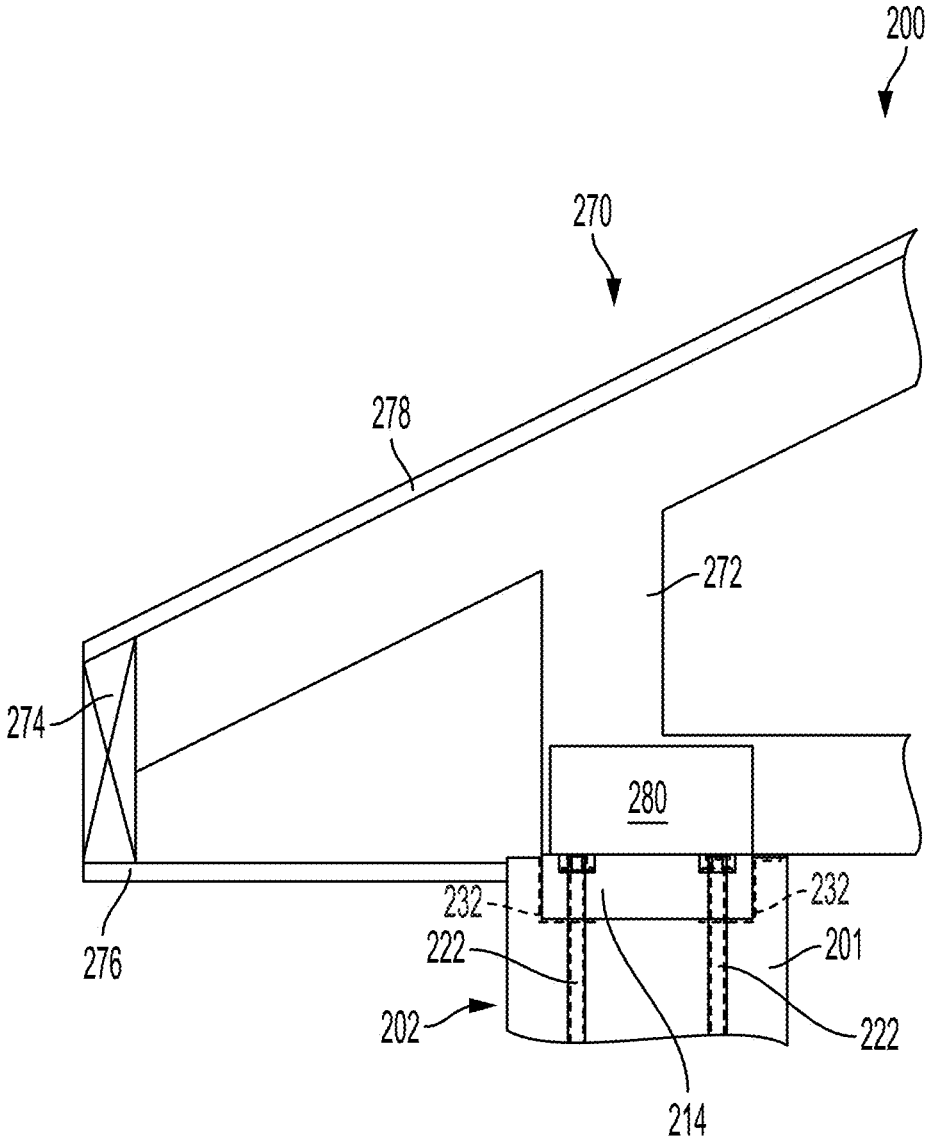
FIG. 9C is a side elevation, cross-section view of a joint between the wall panel of FIG. 2 and another pitched roof assembly.

FIG. 9C shows yet another application of wall panel 202, used in conjunction with a conventional trussed roof assembly 270. Assembly 270 includes an array of trusses 272, shown schematically, with a standard roof covering 278 mounted to trusses 272. Roof covering 278 may be roof shingles, metal panels, or the like, and may be mounted on a decking material fixed to trusses 272. Other conventional details, such as fascia boards 274 and a soffit 276, may be included in roof assembly 270. Roof assembly 270 is connected to the upper surface of wall panel 202 by connectors, which may be plates, angles or the link engineered as required or desired for a particular application. Connectors 280 may be affixed to wall panel 202 via fasteners screwed into or otherwise fixed to the upper board 214.

As noted above, fenestrations such as window opening 204 may also be provided in building assembly 200. In the illustrative embodiment of FIG. 4, window opening 204 is formed by installing a small upper wall panel 202*c* flush with the upper surfaces of two adjacent wall panels 202*b*, 202*e* and a somewhat larger lower wall panel 202*d* flush with the lower surfaces of the adjacent wall panels 202*b*, 202*e*. This creates a rough opening in the remaining open space between the wall panels 202*b*, 202*e* which can be configured to receive a conventional window assembly. Stated another way, the window opening 204 is framed entirely by wall panels made in accordance with the present disclosure, without any separately create wood framing as would be typical for conventional wood-frame walls.

Figure 10:
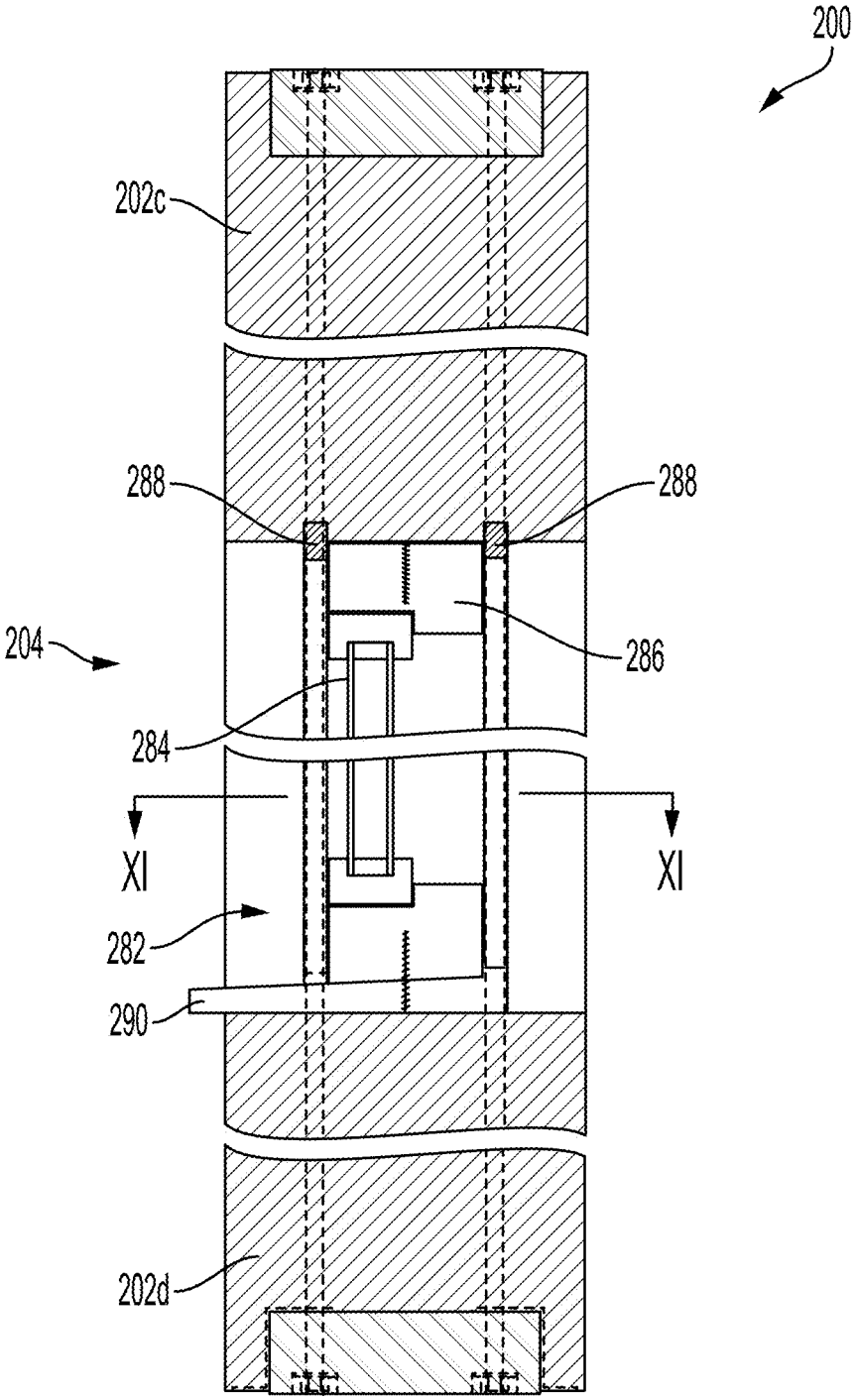
FIG. 10 is a side elevation, cross-section and broken view of the building assembly shown in FIG. 4, taken along the line X-X of FIG. 4, illustrating fenestration details.
Figure 11:
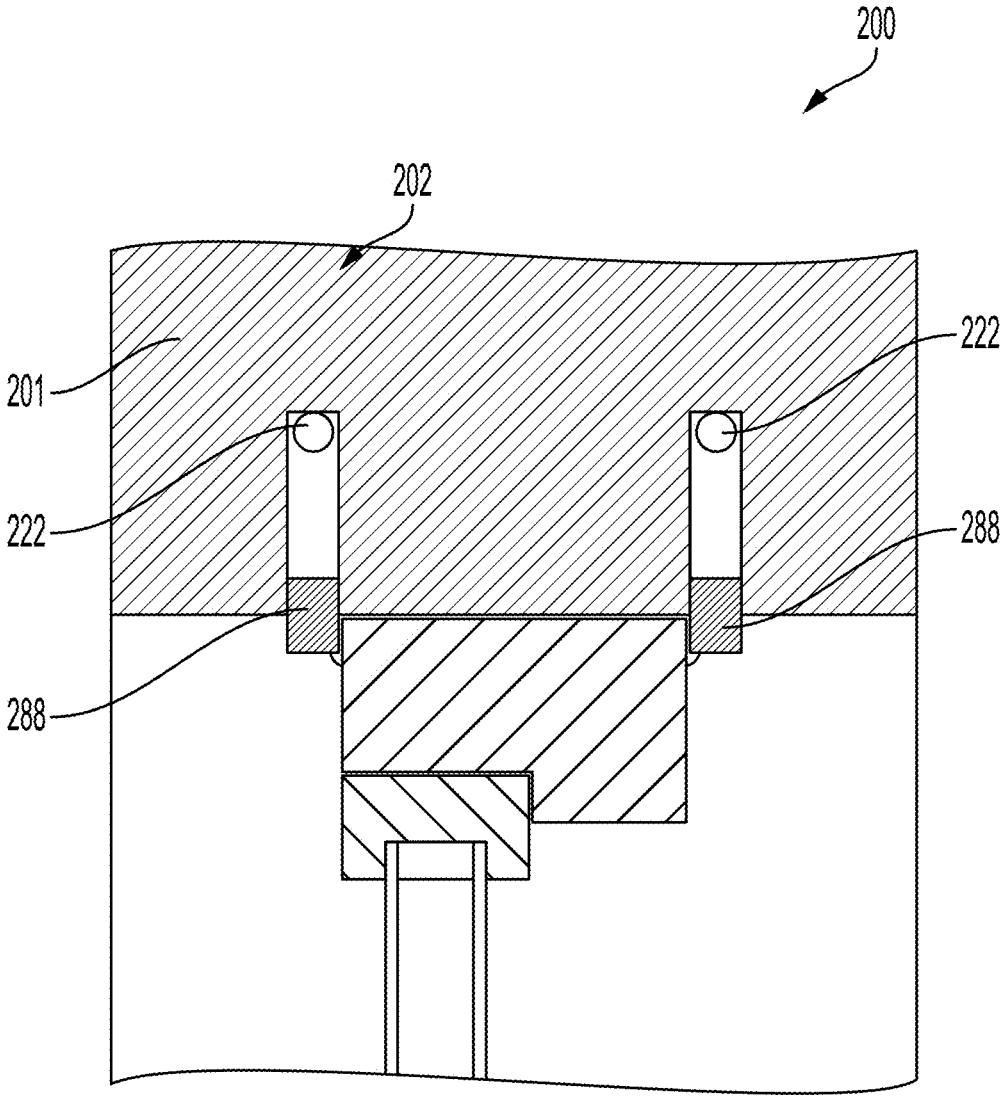
FIG. 11 is a top plan, cross-section view of a portion of the building assembly shown in FIG. 10, taken along the line XI-XI of FIG. 10, illustrating further fenestration details.

Window assembly 282 is installed within window opening 204. Assembly 282 includes a framed glazing panel 284 which itself is surrounded by a window frame 286 (top and bottom members of which are shown in cross section in FIG. 10). These components may be provided as an assembly from a conventional window manufacturer. Window stops 288 may be installed in keyways indexed to the passage of cross members 222 through wall panels 202*c* and 202*d*, as best seen in FIG. 11. Window stops 288 can be placed in one or two upper locations, and one or two lower locations, with a minimum of three stops 288 in either a forward or rear position. This creates a planar arrangement of stops 288 which cooperate to produce an affirmative stop for window assembly 282 to be abutted against. Cross members 222 (or, if they are removed, the channels through which cross members passed) are formed with high spatial and dimensional accuracy, such that their use for window stops 288 creates an easy and accurate method for ensuring proper window placement. Additional window stops 288 may be placed to capture window assembly 282, as shown in FIGS. 10 and 11, to capture and retain the window assembly 282 as it is fixed in place with fasteners. This assembly method places the window assembly 282 in the center of the wall, roughly equidistant from the outer and inner surfaces of wall panels 202*c*, 202*d*.

Upper window stops 288 may be left in place indefinitely. Lower window stops 288 may be removed, with a window sill 290 being placed over the open keyways to prevent water intrusion.

As an alternative to creating an opening spanning the entire distance between the wall panels 202*b*, 202*e*, smaller or larger openings may be made. For a smaller opening, a hole may be cut or machined through a wall panel 202. For a larger opening, a cutout may be cut or machined in one or both of the neighboring wall panels 202*b*, 202*e*, effectively expanding the width of the rough opening which becomes window opening 204. Creating such a cutout also places the weight of the window directly on the substrate 201 of the neighboring panels 202*b*, 202*e*, and avoids stress on any glue or adhesive joint along the vertical surface of a neighboring panel 202*b* or 202*c*.

Optionally, wall panel 202 may include a pattern or mosaic or other visual effect machined into its outer or inner surfaces. This can increase the visual appeal of panel 202 and building assembly 200.

Advantageously, wall panels 202 and other building components, such as roof panels as described above and floor panels similarly constructed, can be prepared and finished in a factory setting. These pre-constructed panels can include fenestration openings, corner and other joinery details, and any other features as may be required or desired for a particular building assembly. The pre-constructed panels can then be shipped to a building site ready for final assembly.

In the case of larger and/or thicker panels, a crane or another mechanized material handling system may be used to lift the panels from a truck and manipulate them into place.

While this invention has been described as having an exemplary design, the present invention may be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains.

What is claimed is:

1. A building comprising:

a foundation;

a wall; and a roof, wherein at least one of the wall and the roof comprises a structural building panel formed of a single, monolithically formed panel of material comprising:

a thickness between 2 inches and 20 inches;

a density between 10 lbs/sq.ft. and 35 lbs/sq.ft.; and an insulation R-value between 2/inch and 3/inch wherein the panel is formed as a substrate having the density and the insulation R-value substantially consistent throughout the entire substrate, the building further comprising a perimeter material fixed to the substrate and having a higher moisture resistance and a higher impact resistance as compared to the substrate, and wherein the substrate has a plurality of grooves formed about its circumference, and the perimeter material comprises a plurality of boards respectively received within the plurality of grooves, at least one of the plurality of boards positioned and configured to contact the foundation and maintain a gap between the substrate and the foundation.

2. The building of claim 1, wherein the wall comprises a plurality of the panels abutting one another, at least one fenestration opening formed in the plurality of panels.

3. The building of claim 2, wherein the fenestration opening is framed entirely by one or more of the plurality of panels.

* * * * *